US006569254B2

(12) United States Patent
Courson et al.

(10) Patent No.: US 6,569,254 B2
(45) Date of Patent: May 27, 2003

(54) LOCALIZED ACIDIC UNDERWATER SURFACE CLEANING APPARATUS

(75) Inventors: Billy Courson, Panama City Beach, FL (US); Felipe Garcia, Panama City, FL (US); John Shelburne, Lynn Haven, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 170 days.

(21) Appl. No.: 09/867,996

(22) Filed: May 30, 2001

(65) Prior Publication Data

US 2002/0179129 A1 Dec. 5, 2002

(51) Int. Cl.[7] ..... B08B 7/00; B63B 59/08

(52) U.S. Cl. ..... 134/3; 114/222; 134/6; 134/41; 134/201

(58) Field of Search ..... 134/3, 6, 41, 201, 134/93; 114/222

(56) References Cited

U.S. PATENT DOCUMENTS 6,045,622 A * 4/2000 Holt et al. ..... 134/6

6,259,653 B1 * 7/2001 Courson et al. ..... 114/222 X 6,380,151 B1 * 4/2002 Masters et al. ..... 134/6 X

* cited by examiner

*Primary Examiner*—Philip Coe

(74) *Attorney, Agent, or Firm*—Harvey A. Gilbert; Donald G. Peck

(57) ABSTRACT

An apparatus and method permits unattended cleaning of a surface. A clamping mechanism engages features around a contaminated surface and is connected to a dome-shaped receptacle containing a gelled acid compound. The gelled acid compound is pressed and held against the contaminated surface during cleaning. Gelled acid ensures that the acid component for dissolving does not readily disburse into the ambient environment. Contamination exposed to the gelled acid compound is dissolved, and the clamping mechanism is disengaged for other cleaning tasks. More reliable attachment of instrumentation and other packages can be made to the cleaned surface. The uncomplicated apparatus and method of the invention allow a single diver to quietly attach packages underwater in the harsh marine environment.

19 Claims, 3 Drawing Sheets

LOCALIZED ACIDIC UNDERWATER SURFACE CLEANING APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to an apparatus for cleaning a surface underwater. More particularly, this invention holds a gelled acidic cleaning agent on a surface to clean the surface underwater or in air.

Scientific research and applications concerning the marine environment have captured the world's attention. Technological developments and equipment for undersea applications are at higher levels than ever before. This increased activity has focussed efforts to securely place a wide variety of systems underwater and making certain that these systems work reliably as they complete their undersea tasks. Generally speaking, marine surfaces should be clean of marine organisms and other marine contamination to reliably attach packages of instrumentation to them. Marine surfaces typically consist of a level of hard, encrusted fouling on the exterior of a base material, such as steel, aluminum, fiberglass, concrete, etc. Contemporary methods for effectively cleaning underwater surfaces still leave much to be desired. Some of these have frameworks supporting scrapers and their mechanical action, agitated wire brushes being held on surfaces, or systems aiming jets of water, and these are usually powered from batteries or remote power sources. Some cleaning appliances are manually powered but most are cumbersome and not user friendly. The old methods are costly, power intensive, noisy, and require one or more operators' constant attention.

Thus, in accordance with this inventive concept, a need has been recognized in the state of the art for a device to clean a surface in air or water by an operator who quickly and quietly attaches a gelled acid compound on the surface and removes it after cleaning is done.

SUMMARY OF THE INVENTION

The present invention provides an apparatus for and method of cleaning a surface in air or underwater quickly and quietly by a single operator. A clamping mechanism engages features around a contaminated surface and is connected to a dome-shaped receptacle containing a gelled acid compound that is pressed against the contaminated surface. Contamination exposed to the gelled acid compound is dissolved, and the clamping mechanism is disengaged.

An object of the invention is to provide an apparatus for and method of quietly cleaning a wet or dry contaminated surface.

Another object of the invention is to provide an apparatus for and method of cleaning a surface permitting attachment and removal by a single operator, such as a diver to clean a surface underwater.

Another object of the invention is to provide an apparatus for and method of cleaning that is uncomplicated and reliably used by a single diver to quietly attach packages underwater in the harsh marine environment.

Another object of the invention is to provide an apparatus for and method of cleaning by an operator that may be left unattended after engagement to features around a contaminated surface.

Another object is to provide an apparatus for and method of cleaning a surface using a gelled acid compound applied by a single operator to permit more reliable adhesion of instrumentation.

These and other objects of the invention will become more readily apparent from the ensuing specification when taken in conjunction with the appended claims.

DESCRIPTION OF THE PREFERRED EMBODIMENT

Figure 1:
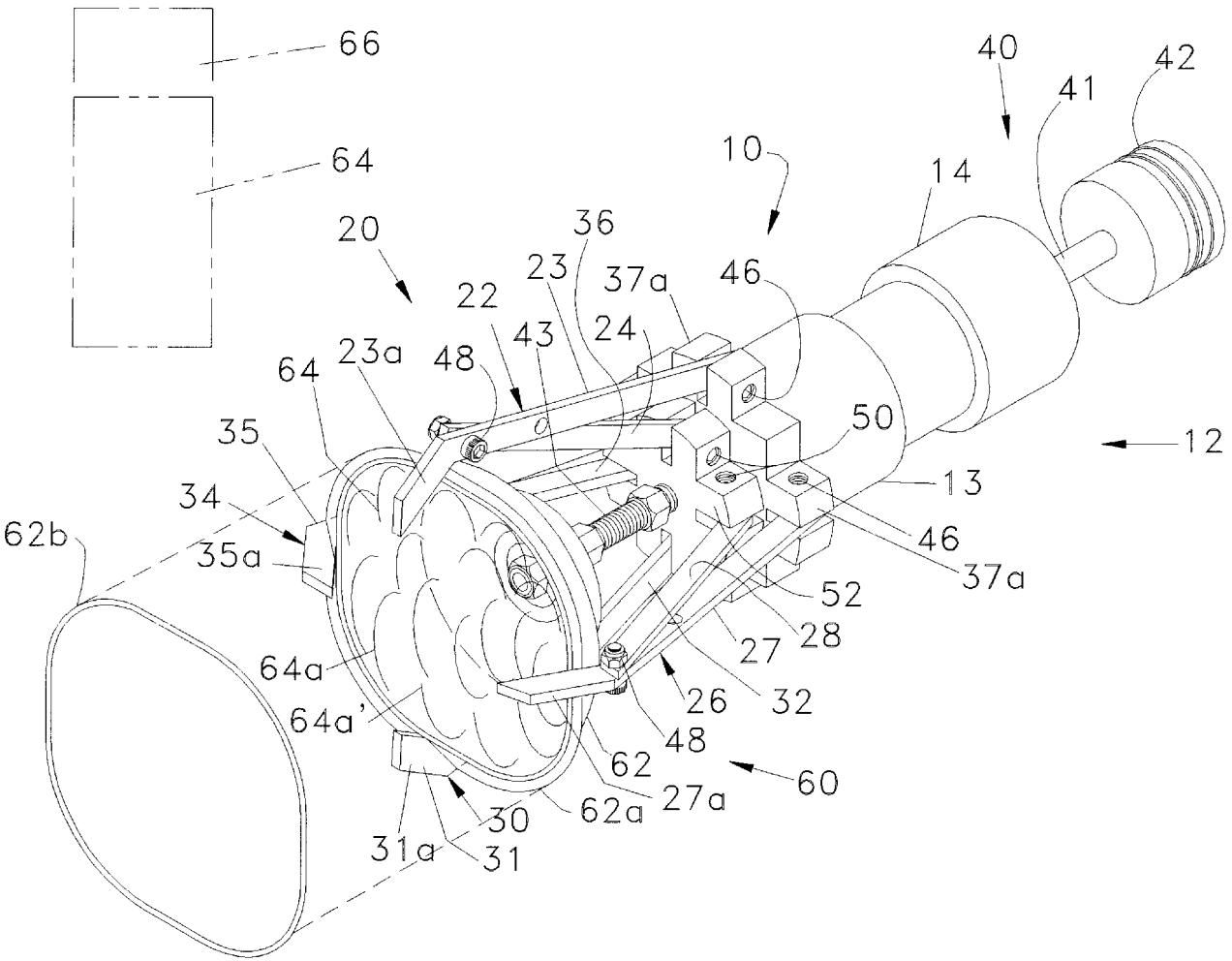
FIG. 1 is an isometric view showing of the apparatus of the invention for cleaning a surface having a clamping mechanism fully retracted and a cleaning module.
Figure 2:
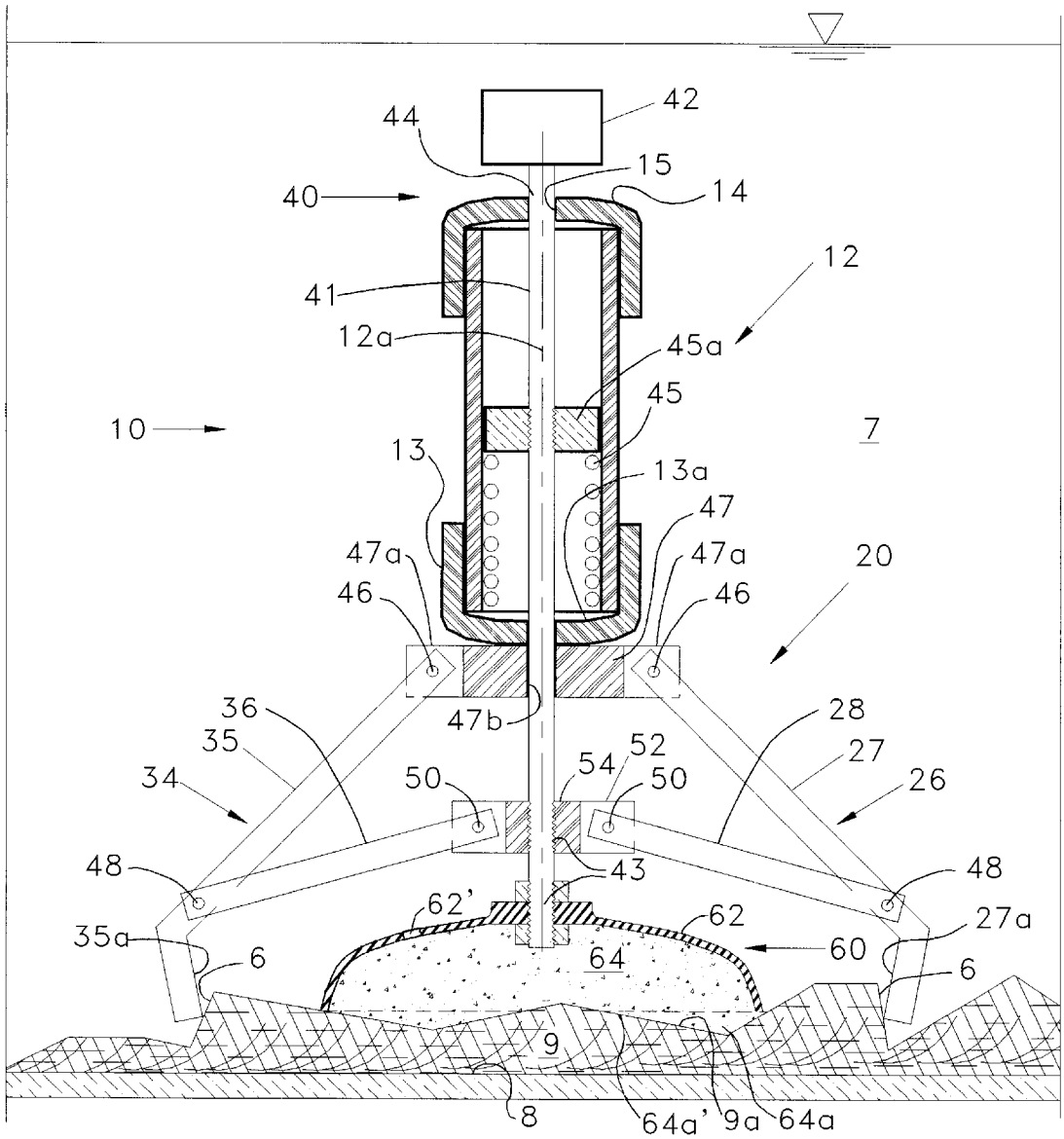
FIG. 2 is a longitudinal cross-section view of the surface cleaning apparatus having the clamping mechanism engaging features to hold gelled acid compound in contact with contamination on the surface.

Referring to FIGS. 1 and 2, cleaning apparatus 10 of this invention has a clamping mechanism 20 extending a cleaning module 60 by an actuating assembly 40. Little instruction is needed for training to position apparatus 10 and securely engage clamping mechanism 20 on features 6 around a surface 8 to permit cleaning module 60 to clean contamination 9 from surface 8.

Contamination 9 is shown in exaggerated form on surface 8, and surface 8 extends as a flat expanse only for the purpose of demonstration. It is understood that the contours and constituency of the layer of contamination 9 can be different than shown. Furthermore, surface 8 may be other than flat and could have irregular features 6 that can protrude upward into the layer of contamination 9 or fall away into small depressions. Surface 8 can be on metal or fiberglass shells housing electronic, monitoring, and communications gear, etc., and/or ordnance, for examples, or may be structural members made from metal, fiberglass, concrete, stone, wood, etc. Cleaning apparatus 10 of this invention effectively cleans these surfaces so that instrumentation and other packages can be more reliably adhered to all of them.

After surface 8 is cleaned, clamping mechanism 20 is disengaged from features 6. Cleaning apparatus 10 can be carried by an operator to another site and reused in another cleaning procedure, and the operator can leave the vicinity while surface 8 is being cleaned. The compact and uncomplicated design of cleaning apparatus 10 not only works well for cleaning dry surfaces on land, but makes it effective and useable in water by a diver where removal of marine contamination from wet surfaces often is not an easy task.

Clamping mechanism 20 has four rigid articulating arm structures 22, 26, 30, and 34 extending outward from a tubular-shaped housing 12. Elongate hooked claw members 23, 27, 31, and 35 of arm structures 22, 26, 30, and 34 are pivotally mounted by pins 46 on outward extensions 47*a* of a rigid block 47 mounted on, or integral with housing 12. Block 47 and cap-wall member 13 of housing 12 are provided with an axial bore 47*b* sized to permit sliding axial displacement of shaft 41 through it.

Rigid connector members 24, 28, 32, and 36 of arm structures 22, 26, 30, and 34, respectively, are each pivotally connected at one end by one of pins 48 to claw members 23, 27, 31, and 35, respectively. Connector members 24, 28, 32, and 36 are pivotally connected at their other ends by pins 50 to outwardly extending parts 52 of follower block 54 that is secured to a threaded end portion 43 of axial shaft 41.

Cleaning module 60 has a dome-shaped receptacle 62 secured to threaded end 43 of axial shaft 41. Dome-shaped receptacle 62 is made from a material that is not dissolved or eaten-away by gelled acid compound 64 while it holds and positions gelled acid compound 64 during cleaning. Dome-shaped receptacle 62 has at least one hole 62' to vent gases from cleaning module 60 formed as acid compound 64 chemically erodes contamination 9. Such venting will prevent gases evolved during cleaning from lifting receptacle 62 off surface 8 and disbursing gelled acid into ambient water 7.

Prior to cleaning a surface, an operator fills receptacle 62 with a gob of gelled acid compound 64 from a storage container 66. The right amount of gelled acid compound 64 is pumped, or otherwise dispensed from container 66 to also create a mound-shaped portion 64*a* of gelled acid compound 64 that extends above lip 62*a* of receptacle 62. Now, cleaning module 60 is ready for cleaning at a work site.

Gel-like cleaning agent 64 may be an acid-based, or acidic compound or agent having the property to chemically react and erode, dissolve, or otherwise eat-away contaminants that may include marine fouling expected to be covering the surfaces that are to be cleaned. Gelled acid ensures that the acid component for dissolving does not readily disburse into the ambient environment. Gelled acid compound 64 may include a solution of hydrochloric acid known as muriatic acid. About twenty-five to thirty-seven percent hydrochloric acid in water can be mixed with a binder-like matrix of fumed silica and polyethylene oxide to form gelled acid compound 64, for example. Gelled acid compound 64 has a viscous, tacky and pliable (almost gum-like) consistency that allows it to be fitted into and adhere to the inner surface of dome-shaped receptacle 62. Compound 64 should be shear thinning and exhibit a yield stress in a manner analogous to non-drip paint. Gelled acid compound 64 also has the property, or consistency to be formed into and maintain mound-shaped portion 64*a* that extends above lip 62*a* of dome-shaped receptacle 62 to create a bulging surface 64*a'* to compliantly engage surface 9*a* of surface 9. Compounds 64 including different mixtures of hydrochloric or other acid with other binder mixtures, or caustic compositions might be selected by one skilled in the art for a variety of cleaning tasks.

When applied to contamination on a dry surface, one exemplary compound of gelled acid material begins to bubble and turn color as it reacts to reduce rust, scale, and barnacles of contamination. The bubbles cause some agitation in the gelled acid mass of the exemplary compound and some mixing action. The gelled acid mass gradually turns completely yellow and dark brown after one-half hour time to permit removal of any loose material under the gelled acid mass by a flat metal scraper. Application of the exemplary compound on the contamination on a wet surface underwater produces essentially the same reaction. One difference is that gas bubbles produced during the reaction tend to disburse individual droplets of gelled acid into ambient water. After about one-half hour, nearly the same result was obtained as before. Placing the exemplary compound in a closed receptacle and holding the exposed part of the exemplary compound on the contamination creates the chemical reaction, and a vent hole releases most of the gases produced during the cleaning reaction.

Dome-shaped receptacle 62 can have a removable cap 62*b* (shown removed from receptacle 62 in FIG. 1) to cover gelled acid compound 64 for underwater cleaning tasks. Cap 62*b* flexes to contain mound-shaped portion 64*a* of gelled acid compound 64 and protect it from premature reactions. Cap 62*b* is removed just before clamping mechanism 20 engages features 6, and exposed gelled acid compound 64 can be pressed onto contamination 9 over surface 8.

Actuating assembly 40 has rigid axial shaft 41 connected to push button 42 to actuate cleaning apparatus 10. An end portion 44 of axial shaft 41 reaches through an opening 15 of cap-wall member 14 of housing 12. A biasing spring 45 wrapped in a helix around shaft 41 is held in compression between a disc member 45*a* threaded onto, or otherwise secured to shaft 41 and an inner surface 13*a* on cap-wall member 13. Biasing spring 45 urges push button 42 and shaft 41 to a position extended from housing 12. Opening 15 permits sliding reciprocal motion by shaft 41 as it is displaced by push button 42 and spring 45. An operator exerts sufficient force on push button 42 to overcome the force exerted by biasing spring 45 and displaces push button 42 inwardly toward housing 12 and moves shaft 41 in the same direction along the longitudinal axis 12*a* of housing 12.

This axial displacement of shaft 41 pushes follower block 54 in the same direction and causes it to open clamping mechanism 20. The moving follower block 54 rotates rigid connector members 24, 28, 32, and 36 about pins 50 in follower block 54 and pins 48 in elongate hooked claw members 23, 27, 31, and 35 of articulating arm structures 22, 26, 30, and 34. This rotation of rigid connector members 24, 28, 32, and 36 causes elongate hooked claw members 23, 27, 31, and 35 to rotate about pins 46. This rotation about pins 46 outwardly displaces end claw portions 23*a*, 27*a*, 31*a*, and 35*a* of claw members 23, 27, 31, and 35 respectively, from their positions on cleaning module 60, see FIG. 1.

As push button 42 contacts the outer surface of cap-wall member 14, elongate hooked claw members 23, 27, 31, and 35 are rotated outwardly to full radial extension from housing 12. The operator grips housing 12 while pushing on button 42, places outer surface 64*a'* of mound-shaped portion 64*a* of gelled acid compound 64 on outer surface 9*a* of contamination 9 above surface 8, and holds push button 42 on member 14 to press compound 64 on surface 8. Outer surface 64*a'* is forced, or pressed against outer surface 9*a* of contamination 9 that covers surface 8. Outer surface 64*a'* and mound-shaped portion 64*a* are confined under this compressive force to pliably accommodate outer surface 9*a*, and chemical erosion of contamination 9 begins.

Pressure is released on push button 42 and biasing spring 45 exerts an outward pushing force on disc member 45*a* to retract shaft 41. As shaft 41 is being retracted, end claw portions 23*a*, 27*a*, 31*a*, and 35*a* are rotated inwardly toward longitudinal axis 12*a*. The retracting force of biasing spring 45 causes end claw portions 23*a*, 27*a*, 31*a*, and 35*a* to grip and engage features 6 of contamination 9 and/or other protrusions of the marine topography around surface 8. This gripping engagement of features 6 holds outer surface 64*a'* and mound-shaped portion 64*a* of gelled acid compound 64 pressed on outer surface 9*a* of contamination 9 above surface 8, and cleaning apparatus 10 is secured in place. The operator can release apparatus 10 and go to another location while cleaning quietly progresses for the duration.

Figure 3:
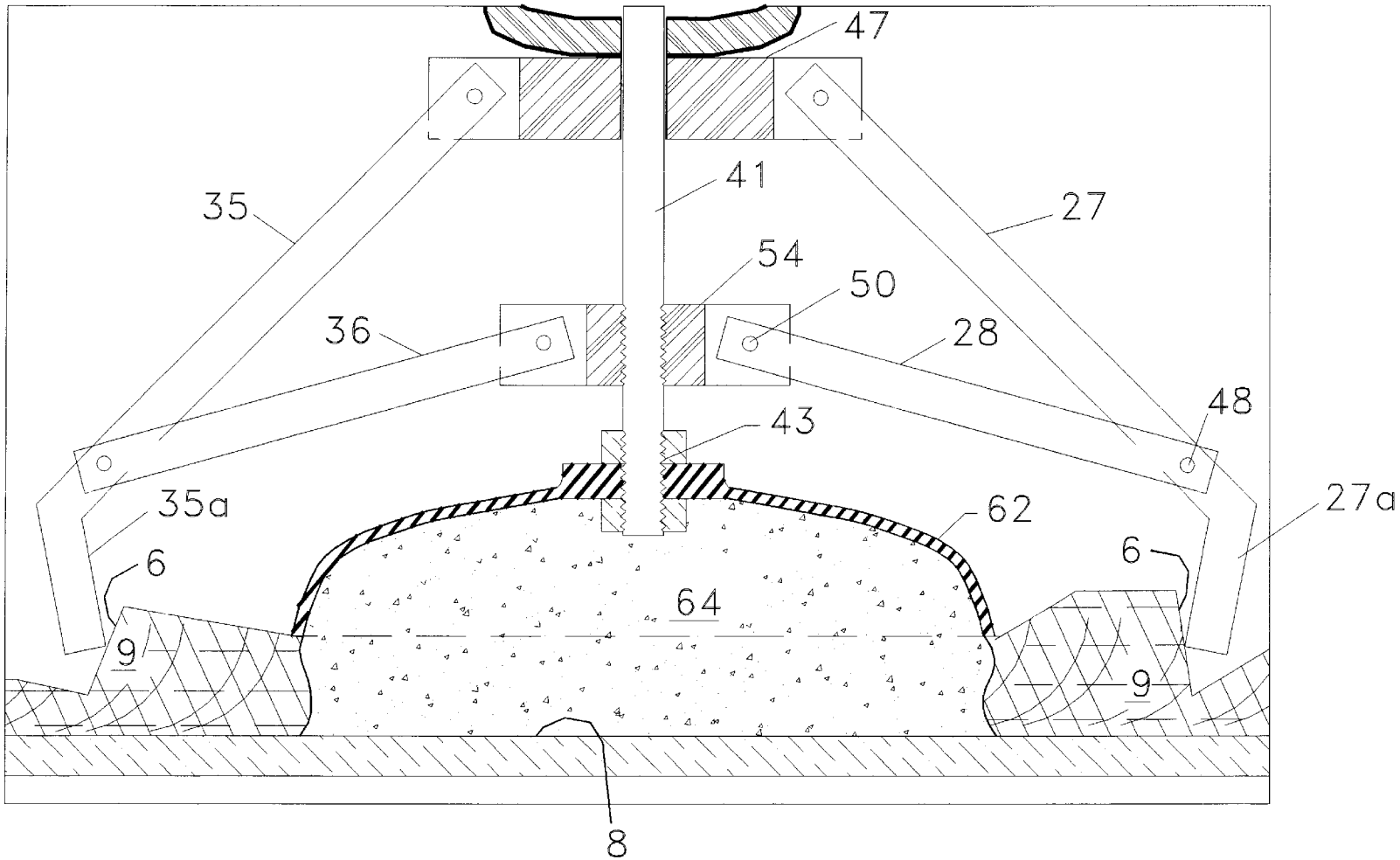
FIG. 3 shows the surface just before disengagement of the clamping mechanism and removal of the apparatus.

After gelled acid compound 64 has sufficiently dissolved or otherwise chemically eroded contamination 9 over surface 8 (see FIG. 3), the operator returns and grips housing 12 while pushing button 42 inwardly. The inward motion of push button 42 axially moves shaft 41 along longitudinal axis 12*a* of housing 12 and opens clamping mechanism 20.

The operator (diver) may use a flat metal scraper to easily scrape away any loose material of by-products of the chemical erosion of contamination 9. The operator can take apparatus 10 to another site where gelled acid compound 64 may be reused and/or another gob from container 66 may be reapplied for cleaning another surface.

The cleaned surface created by cleaning apparatus 10 permits various packages to be more reliably adhered to it. The constituents of cleaning apparatus 10 can be made from non-magnetic materials to reduce interaction with magnetically influenced systems.

Having the teachings of this invention in mind, modifications and alternate embodiments of cleaning apparatus 10 may be adapted. Its uncomplicated, compact design lends itself to numerous modifications to permit its use in the hostile marine environment and on land under conditions that extend between the limits of ambient hot and cold. For examples, cleaning apparatus 10 can be made larger or smaller and fabricated from a wide variety of materials to assure sufficient strength and long term reliable operation under different operational requirements. Housing 12 could have different shapes, and clamping mechanism 20 could have different arrangements of different numbers of differently shaped structural members to clamp onto contaminated surfaces and other features of the marine topography. End claw portions 23*a*, 27*a*, 31*a*, and 35*a* of elongate hooked claw members 23, 27, 31, and 35 may be pick-like structures that dig into or are driven into the marine topography to anchor cleaning apparatus 10 during cleaning.

Another modification within the scope of this inventive concept would be to connect one or both of a modified clamping mechanism 20 and cleaning module 60 directly onto housing 12. This modification might also have a resilient link in each of rigid connector members 24, 28, 32, and 36 that stretches as the clamping mechanism is forced onto marine features. The resilient links would hold end claw portions 23*a*, 27*a*, 31*a*, and 35*a* in engagement on the marine features during cleaning. After cleaning, this modification could be bent or twisted free.

The disclosed components and their arrangements as disclosed herein, all contribute to the novel features of this invention. Cleaning apparatus 10 is a portable, cost-effective, unattended cleaner of surfaces on land or underwater and is quiet and avoid drawing unneeded attention to its operator. Therefore, cleaning apparatus 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An apparatus for cleaning a surface comprising:

a clamping mechanism having claw-like arm structures to engage and disengage features around a surface having contamination thereon; and a cleaning module disposed adjacent to said clamping mechanism having a gelled acid compound to be pressed onto said surface to effect cleaning of said contamination therefrom.

2. An apparatus according to claim 1 further comprising:

an actuating assembly coupled to said cleaning module to press said gelled acid compound onto said surface and to said clamping mechanism to displace said arm structures to engage said features and hold said gelled acid compound on said surface during cleaning thereof.

3. An apparatus according to claim 2 wherein said actuating assembly displaces said arm structures to disengage said features and said gelled acid compound from said surface.

4. An apparatus according to claim 3 wherein said actuating assembly includes a shaft connected to said clamping mechanism and a spring coupled to said shaft to exert a biasing force to close said arm structures.

5. An apparatus according to claim 4 wherein said actuating assembly includes a push button on said shaft to displace said shaft to press said gelled acid compound onto said surface and to engage and disengage said features with said arm structures.

6. An apparatus according to claim 5 wherein said shaft extends through a housing containing said biasing spring, and each of said arm structures includes an elongate hooked claw member each pivotally mounted by a pin to a separate one of outward extensions of a rigid block mounted on said housing, and a separate rigid connector member is pivotally connected at one end by a pin to each of said claw members and is pivotally connected at each of their other ends by a pin to a follower block secured to said shaft.

7. An apparatus according to claim 6 wherein each elongate hooked claw member has an end claw portion to engage said features.

8. An apparatus according to claim 7 wherein said cleaning module has a dome-shaped receptacle secured to said shaft to hold said gelled acid compound.

9. A method of cleaning a surface comprising the steps of:

engaging features around a surface having contamination thereon by claw-like arm structures of a clamping mechanism;

pressing a gelled acid compound in a cleaning module adjacent to said clamping mechanism onto said contamination; and reacting said gelled acid compound with said contamination to erode said contamination from said surface.

10. A method according to claim 9 further comprising the steps of:

disengaging said features by said clamping mechanism; and removing said clamping mechanism and said cleaning module from said features and said surface.

11. A method according to claim 10 wherein said steps of engaging and disengaging includes the steps of:

displacing said arm structures of said clamping mechanism to engage said features and hold said gelled acid compound on said contamination during cleaning and to disengage said features and release said gelled acid compound from said contamination after reaction of said gelled acid compound.

12. A cleaning device comprising:

means for engaging and disengaging features around a surface having contamination thereon by a claw-like arm structures of a clamping mechanism;

means for chemically reacting with said contamination; and means for actuating said chemically reacting means to press against said contamination to effect cleaning of said contamination from a surface.

13. A device according to claim 12 wherein said actuating means closes said arm structures of said engaging and disengaging means to engage said features and hold said chemically reacting means on said surface during cleaning thereof.

14. A device according to claim 13 wherein said actuating means displaces said arm structures of said engaging and disengaging means to disengage said features and said chemically reacting means from said surface after cleaning.

15. A device according to claim 14 wherein said actuating means includes a shaft connected to said engaging and disengaging means and a spring coupled to said shaft to exert a biasing force to close said arm structures.

16. A device according to claim 15 wherein said actuating means includes a push button on said shaft to displace said shaft to press said chemically reacting means onto said surface and to engage and disengage said features with said arm structures.

17. A device according to claim 16 wherein said shaft extends through a housing containing said biasing spring, and each of said arm structures includes an elongate hooked claw member each pivotally mounted by a pin to a separate one of outward extensions of a rigid block mounted on said housing, and a separate rigid connector member is pivotally connected at one end by a pin to each of said claw members and is pivotally connected at each of their other ends by a pin to a follower block secured to said shaft.

18. A device according to claim 17 wherein each elongate hooked claw member has an end claw portion to engage said features.

19. A device according to claim 18 wherein said chemically reacting means has a dome-shaped receptacle secured to said shaft to hold gelled acid compound therein.

* * * * *